US011058272B2

(12) United States Patent
Hulli

(10) Patent No.: US 11,058,272 B2
(45) Date of Patent: Jul. 13, 2021

(54) CONVERTIBLE CENTRAL VACUUM UNIT

(71) Applicant: Nelson Hulli, Toronto (CA)

(72) Inventor: Nelson Hulli, Toronto (CA)

( * ) Notice: Subject to any disclaimer, the term of this patent is extended or adjusted under 35 U.S.C. 154(b) by 106 days.

(21) Appl. No.: 16/383,645

(22) Filed: Apr. 14, 2019

(65) Prior Publication Data

US 2019/0274502 A1 Sep. 12, 2019

Related U.S. Application Data

(63) Continuation-in-part of application No. 15/471,082, filed on Mar. 28, 2017, now abandoned.

(60) Provisional application No. 62/314,034, filed on Mar. 28, 2016.

(51) Int. Cl.

| | |
|---|---|
| ***A47L 9/14*** | (2006.01) |
| ***A47L 5/38*** | (2006.01) |
| ***A47L 9/16*** | (2006.01) |
| ***A47L 5/22*** | (2006.01) |
| ***A47L 9/12*** | (2006.01) |

(52) U.S. Cl.

CPC ..... *A47L 9/1427* (2013.01); *A47L 5/225* (2013.01); *A47L 5/38* (2013.01); *A47L 9/122* (2013.01); *A47L 9/165* (2013.01); *A47L 9/1683* (2013.01)

(58) Field of Classification Search

CPC ..... A47L 9/1427; A47L 9/122; A47L 9/165; A47L 9/1683; A47L 5/225; A47L 5/38

See application file for complete search history.

(56) References Cited

U.S. PATENT DOCUMENTS

| | | | | |
|---|---|---|---|---|
| 4,591,368 | A | 5/1986 | MacDuff | |
| 5,935,279 | A * | 8/1999 | Kilstrom | A47L 9/1691 55/337 |
| 6,158,080 | A | 12/2000 | Schlapkohl | |
| 6,698,059 | B2 | 3/2004 | Biere | |
| 7,461,430 | B2 * | 12/2008 | Reick-Mitrisin | A47L 5/38 15/314 |
| 9,078,550 | B2 * | 7/2015 | Pruitt | A47L 9/1427 |
| 9,131,816 | B2 * | 9/2015 | Pruitt | A47L 9/22 |
| 2004/0060147 | A1 | 4/2004 | Ashe | |
| 2006/0016042 | A1 | 1/2006 | Bruneau | |
| 2006/0081291 | A1 | 4/2006 | Cunningham | |
| 2006/0156504 | A1 | 7/2006 | Bruneau | |
| 2008/0302070 | A1 | 12/2008 | Castronovo | |

* cited by examiner

*Primary Examiner* — Bryan R Muller
*Assistant Examiner* — Makena S Markman
(74) *Attorney, Agent, or Firm* — Robert M Cox, Esq

(57) ABSTRACT

An convertible central vacuum system is disclosed allowing for operation in both a cyclonic separation (bagless) mode as well as in a filter bag mode (via an removable filter bag adapter housing). With each mode having its own advantages and disadvantages, the user can readily convert between them as desired.

4 Claims, 7 Drawing Sheets

CONVERTIBLE CENTRAL VACUUM UNIT

CROSS REFERENCE TO RELATED APPLICATIONS

The present application claims the benefit as a continuation-in-part of U.S. Nonprovisional patent application Ser. No. 15/471,082 filed Mar. 28, 2017 title "Convertible Central Vacuum Unit" with Nelson HULLI as the sole inventor, which is incorporated herein by reference, which itself claimed the benefit of U.S. Provisional Patent Application 62/314,034 filed Mar. 28, 2016

FIELD OF THE INVENTION

The present invention relates to Central Vacuum units for residential or commercial use. In particular, the invention relates to debris and dust management solutions for the main central vacuum unit, in order to allow for more efficient cleaning and flexible maintenance of the unit, while minimizing dust exposure and escape.

BACKGROUND OF THE INVENTION

The present invention is a Central Vacuum unit which can convert between two modes of operation—either operating as a bagless cyclonic separation system (creating a fast-spinning vortex to separate dust and debris into a dust collection bin with centrifugal force) or as a filter bag system via the insertion of a filter bag adapter housing between the motor and canister to allow the use of a filter bag with the same unit. With each mode (cyclonic and filter bag) having its own advantages and disadvantages (as outlined herein), with the present invention the user can now readily convert between them as desired.

Unlike a handheld vacuum, which vents filtered air back into the room while cleaning, the Central Vacuum unit is generally installed in a basement, a closet or another out-of-the-way location, with connecting ports disbursed throughout the home. When cleaning, regardless of which connecting port is used, all of the collected dust and debris is removed from the room being cleaned to the Central Vacuum unit where the vacuum exhaust (and any dust or particulate matter in it) is prevented from returning to the room.

Traditionally, Central Vacuum units can be bagless with a gravity canister beneath the motor collecting dust and debris. These bagless gravity systems also use a foam filter which must be cleaned and/or replaced regularly as the filtrate impedes air flow and reduces suction. Alternatively, traditional central vacuum systems can employ a disposable or reusable filter bag for receiving the debris. Both such systems are considered filtered systems.

Filtered vacuum systems use a wide variety of different bags or filters that must be cleaned (permanent cloth bags) or replaced (disposable paper bags) on a regular basis. Filters can be made from screening, foam, paper or cloth, and are usually proprietary designs that may not be widely available. Over time, the purchase of replacement filters and/or bags can become a significant ongoing expense.

Traditional Central Vacuum systems using a filter bag can suffer from undetected bag breakage. When a portable vacuum suffers bag failure, the condition becomes immediately apparent as the suction power surges and a cloud of dust and debris fills the room. While this result is messy, it is immediately detectable and can be brought under control by turning off the appliance. In contrast, if the filter bag fails in a central vacuum system, the only change noticeable by the remote operator would be a surge in vacuum power as the failed filter bag is bypassed passing dusty air out the exhaust port. Additionally, if the filtered air is used to cool the motor, dirt and debris can accumulate in the motor brushes, windings, or bearings causing the motor to completely seize up. Such motor failure can result in costly repair or replacement of the entire system.

Modern advancements in vacuum systems utilize cyclonic dust separation systems. Pure cyclonic cleaners do not use filters or filtration bags, instead separating the dirt and dust into a detachable cylindrical collection vessel or bin. Air and dust are sucked in at high speed into the collection vessel at a direction tangential to the vessel wall, creating a fast-spinning vortex. Debris and dust particles swirl to the outer wall by centrifugal force, where gravity draws them into the bottom of the collection bin.

In fixed-installation central vacuum cleaners, the cleaned air may be exhausted directly outside without need for further filtration and contains far less debris than a typical clothes dryer exhaust. A well designed cyclonic separation system does not lose suction power due to airflow restriction, until the collection vessel is almost full. This is in marked contrast to filter bag systems, which gradually lose suction as pores in the filter become progressively clogged by collected dirt and dust.

Hybrid cyclonic filtered systems have also been made, which use a rudimentary cyclonic motion to separate out larger dirt particles, but then rely on convention filter bags to trap remaining finer particles. True cyclonic systems are very effective in removing all but the finest particles, which are then exhausted directly outside, completely eliminating the need for cleanable/replaceable filters and their progressive airflow restriction, maintenance and cost.

During use, the dust and debris accumulates and the Central Vacuum unit must be cleaned by emptying the bag or dust collection bin, and by cleaning the filter. Failure to clean the filter or timely empty the bag reduces air-flow and the effectiveness of the unit, and can result in over-heating the motor and permanent damage to the unit. The process of emptying the unit or bag and cleaning the filter is time consuming, and also exposes the user to a significant amount of dust. However, a bag is generally considered better for those with allergies or other dust sensitive issues, in order reduce the direct exposure to the dust. Though bagged units offer some advantages related to dust exposure when cleaning, bagged units are also the most susceptible to reduced air flow as the bag fills.

Without a bag, the need to clean the machine has several drawbacks, and failure to clean the machine can result in reduced performance, costly damage, and possible safety concern. However, as mentioned above, the use of a bag can create additional susceptibility to air-flow problems and also reduce the performance of the machine.

Accordingly, the purpose of the present invention is to provide a single convertible system providing both a cyclonic separation operating mode, as well as filter bag operating mode (via a removable filter bag adapter housing), providing the benefits of modern cyclonic operation, with the flexibility for use of a debris bag for a more dust-free and efficient cleanup when desired (based either on the mess being cleaned or the general preferences of the operator/owner of the system).

SUMMARY OF THE INVENTION

The current invention provides a cyclonic separation Central Vacuum unit featuring a pair of interchangeable intermediate structures that install between the upper housing and the lower housing, allowing the user to readily switch between cyclonic separation operation and filter bag operation. The first interchangeable intermediate structure (for cyclonic separation) is a removable ridged trap funnel (with a wider top side that attaches near the junction between the upper housing and the lower housing and a narrower lower side that protrudes downward into the lower housing) and which is installed along with a removable filter on the motor housing. The second interchangeable intermediate structure (for filter bag operation) is a removable filter bag adaptor housing (with a separate filter bag intake port) and which is installed along with a removable cap to seal the cyclonic separation intake port but without the removable filter on the motor housing. In cyclonic separation operation, the machine can function cyclonically with a motor filter and no bag, improving suction power and reducing the reliance on consumables. In filter bag operation, the collected dust and debris goes inside the bag, and no dust will accumulate within the Central Vacuum unit, eliminating the need for a motor filter, minimizing environmental exposure to dust via exhaust outlet, and reducing the cleaning and maintenance necessary.

BRIEF DESCRIPTION OF THE DRAWINGS

Preferred and alternative examples of the present invention are described in detail below with reference to the following Figure drawings.

DETAILED DESCRIPTION

Figure 1:
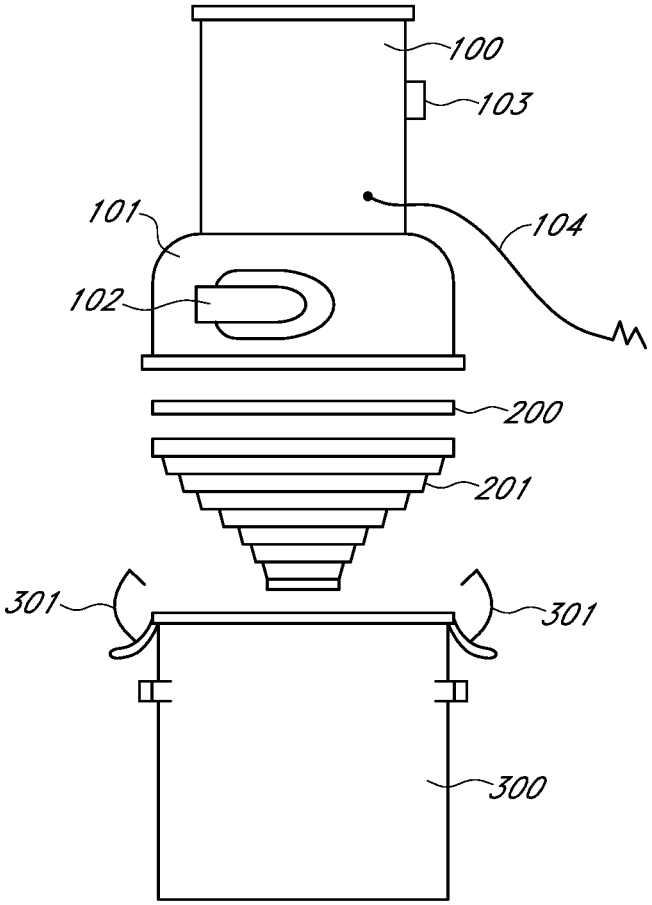
FIG. 1 is a side view (exploded) of a convertible central vacuum unit configured in cyclonic separation mode, utilizing the removable trap funnel and removable gasket.
Figure 2:
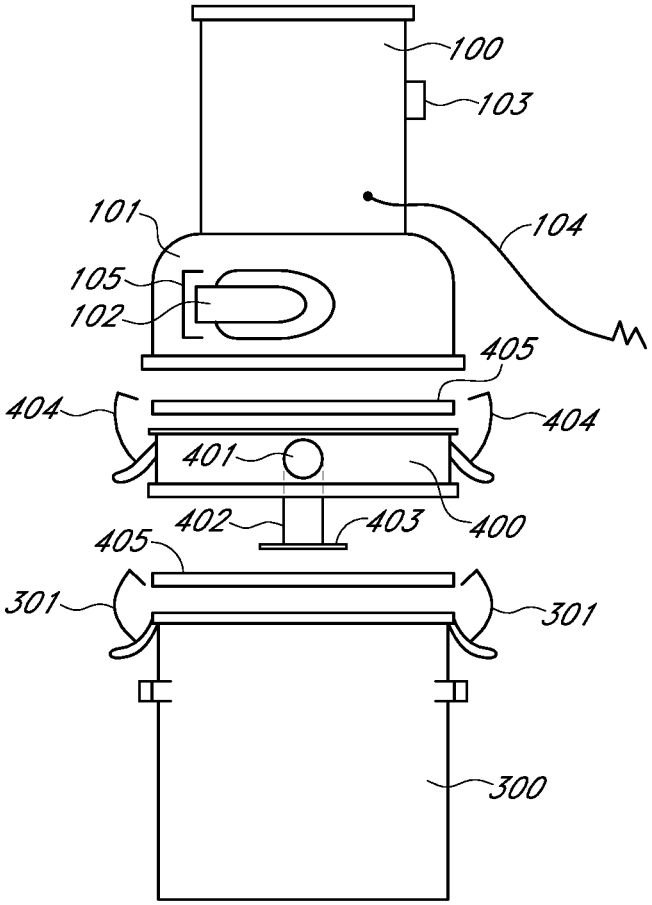
FIG. 2 is a side view (exploded) of a convertible central vacuum unit configured in filter bag mode, utilizing the removable filter bag adapter housing and a seal (cap) on the cyclonic separation intake.
Figure 3:
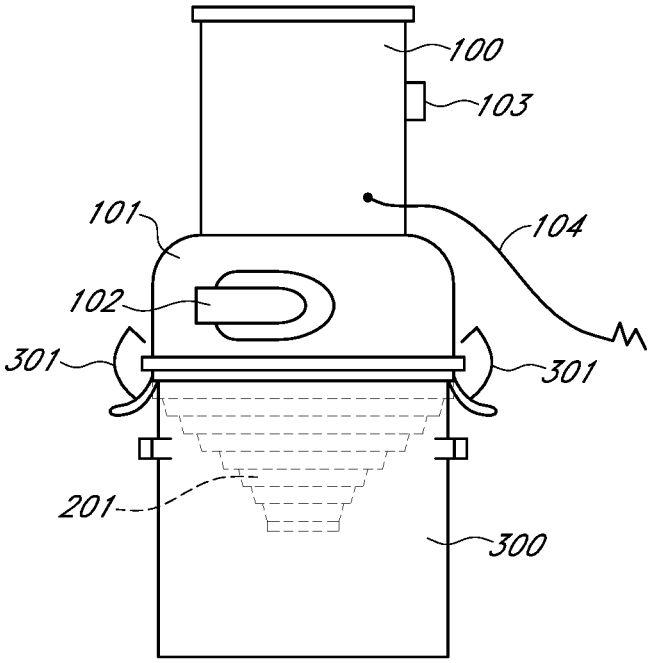
FIG. 3 is a side view (assembled) of a convertible central vacuum unit configured in cyclonic separation mode.
Figure 4:
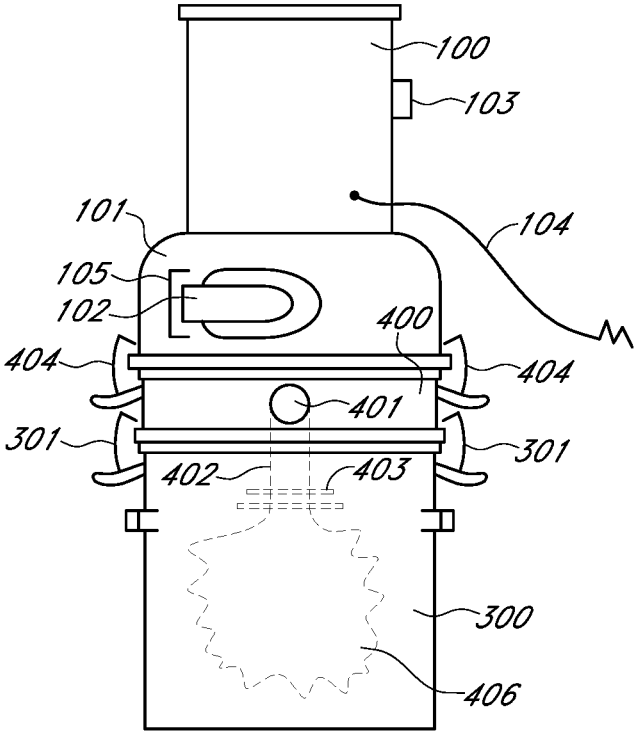
FIG. 4 is a side view (assembled) of a convertible central vacuum unit configured in filter bag mode.

The invention shown in FIG. 1 (exploded diagram) and FIG. 3 (assembled) is a Convertible Central Vacuum Unit, as configured in cyclonic separation mode. The invention shown in FIG. 2 (exploded diagram) and FIG. 4 (assembled) is a Convertible Central Vacuum Unit, as configured in filter bag mode.

Figure 5:
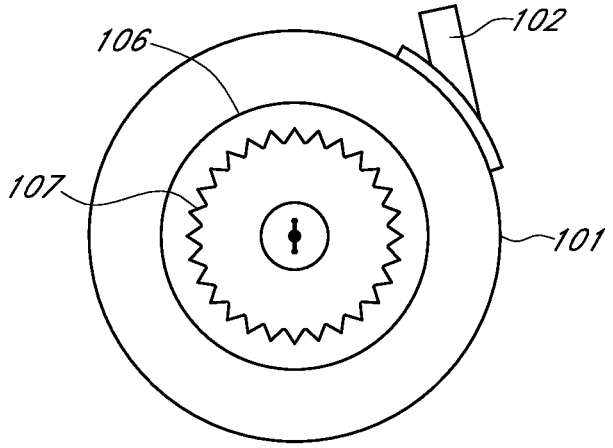
FIG. 5 is a bottom view looking up into the filter housing, showing the filter holder and the removable filter.
Figure 6:
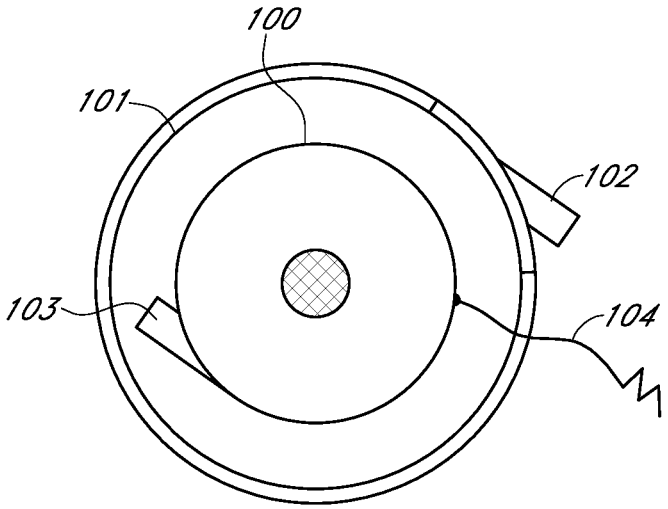
FIG. 6 is a top view looking down at the exterior of the upper housing (the motor housing and the filter housing)

The Convertible Central Vacuum Unit has an upper housing comprising a motor housing 100 and a filter housing 101 and a lower housing serving as a dust collecting bin 300. The motor housing 100 comprises the motor and power source, as well as the exhaust outlet 103 and power cord 104, as also shown in FIG. 6 (top down exterior view of the upper housing: the motor housing and the filter housing). The filter housing 101 comprises a removable filter 107 in a filter holder 106, as well as the cyclonic separation intake port 102 as also shown in FIG. 5 (interior view of filter housing). The lower housing further comprises latches 301 (or other connectors) to securely attach the lower housing to the adjacent section.

In cyclonic separation mode, no bag is used and an intake hose is attached to the cyclonic separation intake port 102. During cleaning, the debris and dust are drawn through the intake hose (not shown) into a cyclonic separation vortex formed between the outer wall of the filter housing 101 and the filter holder 106, allowing dust and debris to spiral out to the outer wall of the filter housing 101 (where gravity pulls dust and debris down through the removable trap funnel 201 to settle on the bottom of the dust collecting bin 300 without being disturbed by the vortex above the removable trap funnel). Furthermore, in cyclonic separation mode, exhaust air is drawn through the removable filter 107, on through the vacuum motor, and exhausted through the exhaust outlet 103. In cyclonic separation mode, only the removable trap funnel 201 and seal gasket 200 are assembled between the upper housing 100, 101 and lower housing 300.

In filter bag mode, the removable trap funnel 201 and removable gasket 200 are set aside, a removable seal (such as a cap) 105 is installed on the cyclonic separation intake port 102, and the removable filter bag adapter housing 400 is assembled directly between the upper housing 100, 101 and lower housing 300 using a pair of filter bag adapter gaskets 405 to ensure a seal.

Figure 7:
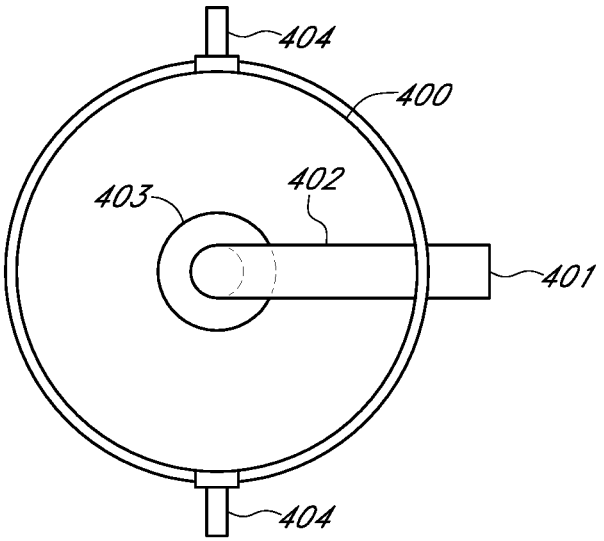
FIG. 7 is a top down view of a removable filter bag adapter housing.
Figure 8:
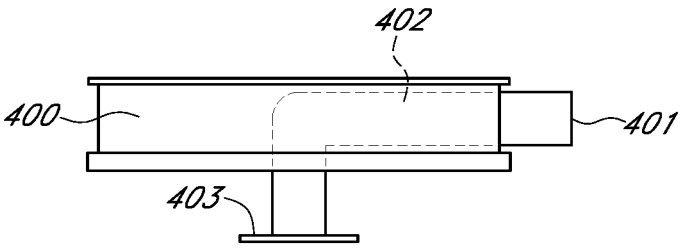
FIG. 8 is a side view of a removable filter bag adapter housing.
Figure 9:
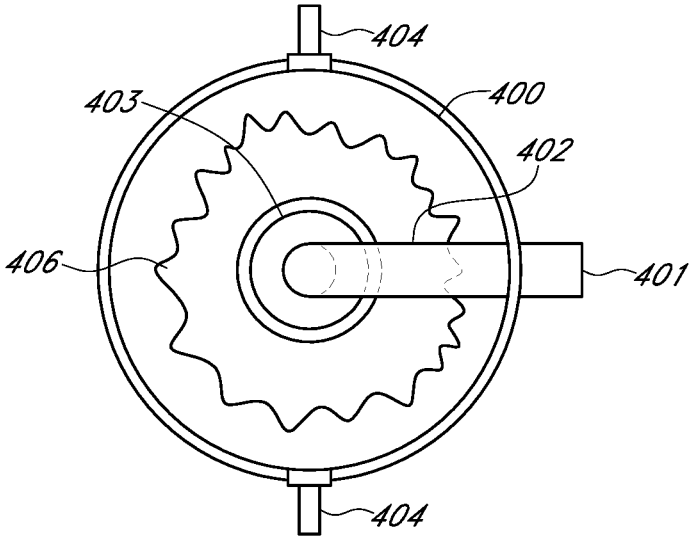
FIG. 9 is a top down view of a removable filter bag adapter housing with a filter bag.
Figure 10:
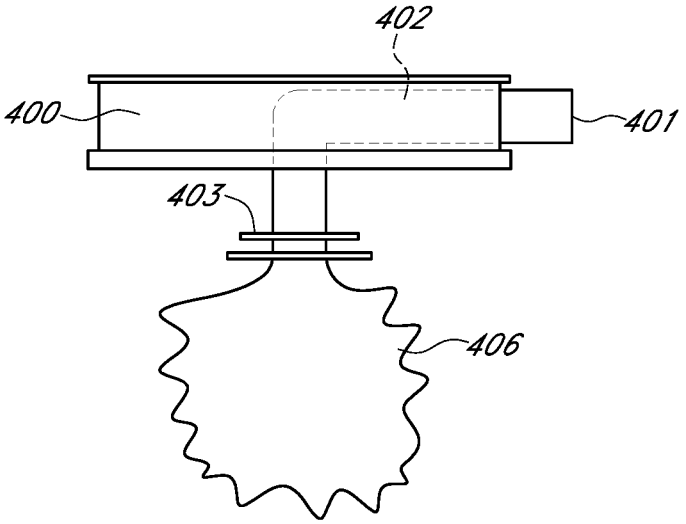
FIG. 10 is a side view of a removable filter bag adapter housing with a filter bag.

The removable filter bag adapter housing 400 is illustrated in FIG. 7 (top view, without filter bag installed), FIG. 8 (side view, without filter bag installed), FIG. 9 (top view, with filter bag installed), and FIG. 10 (side view, with filter bag installed) also includes latches 404 (or other connectors) to securely attach the removable filter bag adapter housing 400 to the upper housing 100, 101. The removable filter bag adapter housing 400 further comprises a filter bag intake port 401 to attach an intake hose to (not shown), an intake pipe 402 which channels the dust, debris and air downwards directly into a filter bag 406 attached to filter bag attachment point 403. As the air, dust and debris passes though the filter bag 406, it serves as an air filter, where dust and debris are retained for easy removal while filtered air is allowed to be drawn through the vacuum motor and out the exhaust outlet 103.

The embodiments of the invention in which an exclusive property or privilege is claimed are defined as follows:

1. A central vacuum system, comprising:

an upper housing;

a lower housing;

a pair of interchangeable intermediate structures disposed between said upper housing and said lower housing;

wherein the upper housing comprises a motor housing, a filter housing, an exhaust outlet and a cyclonic separation intake port;

wherein the motor housing comprises a motor and a power source;

wherein the filter housing comprises a filter holder;

wherein the filter holder comprises a removable filter;

wherein the cyclonic separation intake port is positioned externally on the upper housing;

wherein the cyclonic separation intake port is angled tangentially to the upper housing to initiate cyclonic spin as debris-filled air is drawing through the cyclonic separation intake port into the upper housing;

wherein the pair of interchangeable intermediate structures comprises a first interchangeable intermediate structure for cyclonic separation operation and a second interchangeable intermediate structure for filter bag operation;

wherein the first interchangeable intermediate structure for cyclonic separation operation comprises a removable trap funnel comprising a wider diameter top and a narrower diameter bottom;

wherein the wider diameter top of the removable trap funnel is installed at the top of the lower housing;

wherein the narrower diameter bottom of the removable trap funnel protrudes downward into the lower housing;

wherein the second interchangeable intermediate structure for filter bag operation comprises a removable filter bag adaptor housing;

wherein the removable filter bag adaptor housing is cylindrical;

wherein the removable filter bag adaptor housing is installed between the upper housing and the lower housing;

wherein the removable filter bag adaptor housing comprises a filter bag intake port, a filter bag attachment point and an intake pipe;

wherein the filter bag intake port is positioned externally on the removable filter bag adaptor housing;

wherein the filter bag intake port is angled radially to the removable filter bag adaptor housing;

wherein the intake pipe and the filter bag attachment point are positioned inside the removable filter bag adaptor housing;

wherein the intake pipe connects the filter bag intake port to the filter bag attachment point;

wherein the filter bag attachment point further comprises a disposable filter bag;

wherein the disposable filter bag orients downward toward the lower housing; and, wherein the cyclonic separation intake port is sealable during filter bag operation.

2. The central vacuum system of claim 1 wherein the cyclonic separation intake port further comprises a removable cap for sealing the cyclonic separation intake port during filter bag operation.

3. The central vacuum system of claim 1 wherein the removable trap funnel comprises one or more concentric circular ridges.

4. The central vacuum system of claim 1 wherein the first interchangeable intermediate structure for cyclonic separation operation further comprises a removable seal between the upper housing and the lower housing.

* * * * *